US005378251A

United States Patent [19]

Culler et al.

[11] Patent Number: 5,378,251

[45] Date of Patent: Jan. 3, 1995

[54] ABRASIVE ARTICLES AND METHODS OF MAKING AND USING SAME

[75] Inventors: Scott R. Culler, Burnsville; Gregory A. Berg; Jon R. Pieper, both of Lindstrom; Richard M. Olson, Stillwater, all of Minn.

[73] Assignee: Minnesota Mining and Manufacturing Company, St. Paul, Minn.

[21] Appl. No.: 121,110

[22] Filed: Sep. 13, 1993

Related U.S. Application Data

[60] Continuation-in-part of Ser. No. 29,302, Mar. 8, 1993, Pat. No. 5,304,223, which is a continuation of Ser. No. 921,905, Jul. 29, 1992, abandoned, which is a division of Ser. No. 651,660, Feb. 6, 1991, Pat. No. 5,152,917.

[51] Int. Cl.[6] ..... B24D 3/02

[52] U.S. Cl. ..... 51/295; 51/307; 451/28

[58] Field of Search ..... 51/293, 295, 298, 308, 51/309, 281 R, 307

[56] References Cited

U.S. PATENT DOCUMENTS

| | | | |
|---|---|---|---|
| 1,657,784 | 1/1928 | Bergstrom | 51/295 |
| 2,001,911 | 5/1935 | Wooddell et al. | 51/190 |
| 2,108,645 | 2/1938 | Bryant | 51/68 |
| 2,252,683 | 8/1941 | Albertson | 51/298 |
| 2,292,261 | 8/1942 | Albertson | 51/298 |
| 2,682,733 | 7/1954 | Buckner | 51/188 |
| 2,755,607 | 7/1956 | Haywood | 51/185 |
| 2,820,746 | 1/1958 | Keeleric | 204/16 |
| 2,907,146 | 10/1959 | Dyar | 51/195 |
| 3,048,482 | 8/1962 | Hurst | 51/298 |
| 3,246,430 | 4/1966 | Hurst | 51/293 |
| 3,684,348 | 8/1972 | Rowland | 350/103 |
| 3,689,346 | 9/1972 | Rowland | 156/245 |
| 3,861,892 | 1/1975 | Wisdom, Jr. et al. | 51/295 |
| 4,037,367 | 7/1977 | Kruse | 51/209 S |
| 4,112,631 | 9/1978 | Howard | 51/295 |
| 4,311,489 | 1/1982 | Kressner | 51/295 |
| 4,318,766 | 3/1982 | Smith | 156/330 |
| 4,420,527 | 12/1983 | Conley | 428/172 |
| 4,539,017 | 9/1985 | Augustin | 51/293 |
| 4,576,850 | 3/1986 | Martens | 428/156 |
| 4,652,274 | 3/1987 | Boettcher et al. | 51/298 |
| 4,735,632 | 4/1988 | Oxman et al. | 51/295 |
| 4,751,138 | 6/1988 | Tumey et al. | 51/295 |
| 4,773,920 | 9/1988 | Chasman et al. | 51/295 |
| 4,903,440 | 2/1990 | Larson et al. | 51/298 |
| 4,908,046 | 3/1990 | Wiand | 51/293 |
| 4,930,266 | 6/1990 | Calhoun et al. | 51/293 |
| 5,011,512 | 4/1991 | Wald et al. | 51/293 |
| 5,011,513 | 4/1991 | Zador et al. | 51/295 |
| 5,014,468 | 5/1991 | Ravipati et al. | 51/295 |
| 5,022,895 | 6/1991 | Wiand | 51/295 |
| 5,078,753 | 1/1992 | Broberg et al. | 51/298 |
| 5,152,917 | 10/1992 | Pieper et al. | 51/295 |
| 5,269,821 | 12/1993 | Helmin et al. | 51/295 |

FOREIGN PATENT DOCUMENTS

| | | |
|---|---|---|
| 0396150 | 11/1990 | European Pat. Off. . |
| 881239 | 4/1943 | France . |
| 2-83172 | 3/1990 | Japan . |
| 4-159084 | 6/1992 | Japan . |
| 1005448 | 9/1965 | United Kingdom . |

*Primary Examiner*—Mark L. Bell
*Assistant Examiner*—Deborah Jones
*Attorney, Agent, or Firm*—Gary L. Griswold; Walter N. Kirn; Jeffrey L. Wendt

[57] ABSTRACT

An abrasive article is presented which includes a backing having a front and back surface, and an abrasive coating bonded to the front surface of the backing. The abrasive coating comprises a homogeneous mixture of a plurality of abrasive particles, a binder and a grinding aid. The binder serves to bond the abrasive coating to the backing and the grinding aid comprises at least 1% by weight of the abrasive coating, but not more than 50% by weight. It is preferred that the abrasive coating consists essentially of a plurality of precisely shaped abrasive composites. Methods of making and using the abrasive articles are also presented.

11 Claims, 2 Drawing Sheets

ABRASIVE ARTICLES AND METHODS OF MAKING AND USING SAME

CROSS-REFERENCE TO RELATED APPLICATIONS

This application is a continuation-in-part of Ser. No. 08/029,302, filed Mar. 8, 1993, now U.S. Pat. No. 5,304,223, which was a continuation of Ser. No. 07/921,905, filed Jul. 29, 1992, now abandoned, which was a division of Ser. No. 07/651,660, filed Feb. 6, 1991, now U.S. Pat. No. 5,152,917.

FIELD OF THE INVENTION

This invention pertains to an abrasive article, a method of making such an abrasive article and a method of using such an abrasive article. The abrasive article comprises a backing having an abrasive coating bonded to at least one surface of the backing. The abrasive coating comprises a binder, a plurality of abrasive particles, and a grinding aid dispersed in the binder. The binder also serves to bond the abrasive coating to the backing.

BACKGROUND ART

Abrasive articles have been utilized to abrade and finish workpieces surfaces for well over a hundred years. These applications have ranged from high stock removal, high pressure metal grinding processes to fine polishing of ophthalmic lenses. In general abrasive articles comprise a plurality of abrasive particles bonded either together (e.g., a bonded abrasive or grinding wheel) or to a backing (e.g., a coated abrasive). For a coated abrasive there is typically a single, or sometimes two layers of abrasive particles. Once these abrasive particles are worn, the coated abrasive is essentially worn out and is typically discarded.

One solution to this single layer of abrasive particles is described in the following U.S. Pat. Nos. 4,652,275; 4,799,939 and 5,039,311. The coated abrasive that is disclosed in these references comprises a backing having a plurality of abrasive agglomerates bonded to the backing. The abrasive agglomerate is a shaped mass comprising abrasive grains, a binder, optionally a grinding aid and optionally other additives. These abrasive agglomerates essentially result in a three dimensional coating of abrasive particles.

Another three dimensional coating of abrasive particles is an abrasive lapping film. A lapping film, like that disclosed in U.S. Pat. Nos. 4,644,703, 4,773,920 and 5,015,266, consists essentially of an abrasive slurry comprising abrasive particles and a binder bonded to a backing. These lapping films have had wide commercial success in polishing applications where a fine surface finish on a workpiece is desired. However, these lapping films do not always have the desired rate of cut for many other applications.

A means to increase the cut rate of lapping films is disclosed in U.S. Pat. No. 5,152,917 (Pieper et al.).

Pieper teaches a structured abrasive that results in a relatively high rate of cut and a relatively fine surface finish on the workpiece surface. The structured abrasive comprises non-random, precisely shaped abrasive composites that are bonded to a backing.

Pieper is a significant advancement in the abrasives art especially for abrading painted surfaces, however there is always room for improvement in abrading metal workpieces.

U.S. Ser. No. 08/120,300, filed Sep. 13, 1993, (Hoopman) discloses articles having shaped composites of differing dimensions.

SUMMARY OF THE INVENTION

This invention pertains to an abrasive article, a method of making an abrasive article and a method of using an abrasive article.

In the first aspect of the invention, an abrasive article is presented comprising:

a. a backing having a front and back surface; and b. an abrasive coating bonded to the front surface of the backing wherein the abrasive coating comprises a homogeneous mixture of a plurality of abrasive particles, a binder and a grinding aid; wherein the binder serves to bond the abrasive coating to the backing and wherein the grinding aid comprises at least 1% by weight of the abrasive coating, but not more than 50% by weight (preferably not more than 30%).

Regarding the first aspect of the invention, it is preferred that the abrasive coating consists essentially of a plurality of precisely shaped abrasive composites. These abrasive composites have a precise shape defined by a distinct and discernible boundary. The shaped composites may be either non-randomly or randomly shaped, as per U.S. Pat. No. 5,152,917 and U.S. Ser. No. 08/120,300, both of which are incorporated herein by reference for their teaching of shaped composites.

In a second aspect, a method of making the inventive abrasive article of the first aspect is presented, the invention comprising:

a. preparing a slurry comprising a plurality of abrasive particles, a binder precursor and a grinding aid;

b. providing a backing having a front and back surface;

c. applying the slurry onto at least the front surface of the backing;

d. exposing the slurry to conditions sufficient to solidify the binder precursor to form a binder, where upon solidification the slurry is converted into an abrasive coating, wherein the abrasive coating comprises by weight at least 1% but no more than 50 wt.% (preferably not more than 30 wt.%) grinding aid and wherein the binder serves to bond the abrasive coating to the backing.

Two preferred methods within the second aspect are the third and fourth aspects of the invention.

In the third aspect, the method comprises:

a. preparing a slurry comprising a plurality of abrasive particles, a binder precursor and a grinding aid;

b. providing a backing having a front and back surface;

c. providing a production tool containing a plurality of cavities;

d. applying the slurry into the plurality of cavities in the production tool such that the slurry flows into the cavities;

e. contacting the front surface of the backing with the production tool such that the slurry wets the front surface of the backing; and f. exposing the slurry to conditions sufficient to solidify the binder precursor to form a binder, where upon solidification the slurry is converted into a plurality of abrasive composites that have a precise shape defined by a distinct and discernible boundary and wherein the abrasive composites comprise by weight at least 1% but no more than 50% (preferably no more than 30%) grinding aid.

In the fourth aspect of the invention, the method comprises:

a. preparing a slurry comprising a plurality of abrasive particles, a binder precursor and a grinding aid;
b. providing a backing having a front and back surface;
c. applying the slurry onto the front surface of the backing to form a slurry coated backing;
d. contacting the slurry coated backing with a production tool having a plurality of cavities, such that the slurry flows into the cavities;
e. exposing the slurry to conditions sufficient to solidify the binder precursor to form a binder, where upon solidification the slurry is converted into a plurality of abrasive composites, the abrasive composites comprising by weight at least 1% but no more than 50% (preferably no more than 30 wt.%) grinding aid.

Slurries useful in the invention comprise a plurality of abrasive particles, a binder precursor and a grinding aid. The term "binder precursor" a composition which is in a liquid state and is not polymerized or cured. This liquid state results in the slurry being able to flow or to be coated onto the backing and into cavities of the backing, if present. The slurry is then exposed to an energy source to cure or polymerize the binder precursor to form a binder. This polymerization process also results in the slurry being converted into an abrasive coating. The energy source can be thermal energy or radiation energy (e.g., electron beam, ultraviolet light or visible light).

The fifth aspect of the invention is a method of abrading a methyl surface of a workpiece, the method comprising the steps of:

a. bringing into frictional contact a metal surface and an abrasive article, wherein the abrasive article comprises:
   i) a backing having a front and back surface;
   ii) an abrasive coating bonded to at least the front surface of the backing, wherein the abrasive coating comprises a homogeneous mixture of a plurality of abrasive particles, a binder and a grinding aid; wherein the binder also serves to bond the abrasive coating to the backing and wherein the abrasive coating comprises by weight at least 1% but not more than 50% grinding aid, and wherein at least one of the abrasive article or the metal surface are moved in relation to each other during frictional contact such that a portion of the metal surface of the workpiece is removed.

The abrasive coating preferably comprises at least about 1% by weight, more preferably at least about 5% by weight, more preferably at least about 10% by weight and most preferably at least about 20% by weight grinding aid, but no more than 50%, preferably no more than 30%. The particularly preferred weight % of grinding aid will depend on the workpiece and grinding aid. The preferred grinding aids are cryolite and potassium tetrafluoroborate ($KBF_4$).

The term "homogeneous mixture" means that the abrasive particles/binder/grinding aid are preferably uniformly present throughout the abrasive coating or throughout each abrasive composite. It will be understood that the abrasive particles or binder or grinding aid may have a slightly higher concentration in one region of the abrasive coating or abrasive composites, however significantly higher concentration of grinding aid in one region is not preferred.

DESCRIPTION OF PREFERRED EMBODIMENTS

This invention pertains to an abrasive article, a method of making an abrasive article and a method of using an abrasive article.

Figure 1:
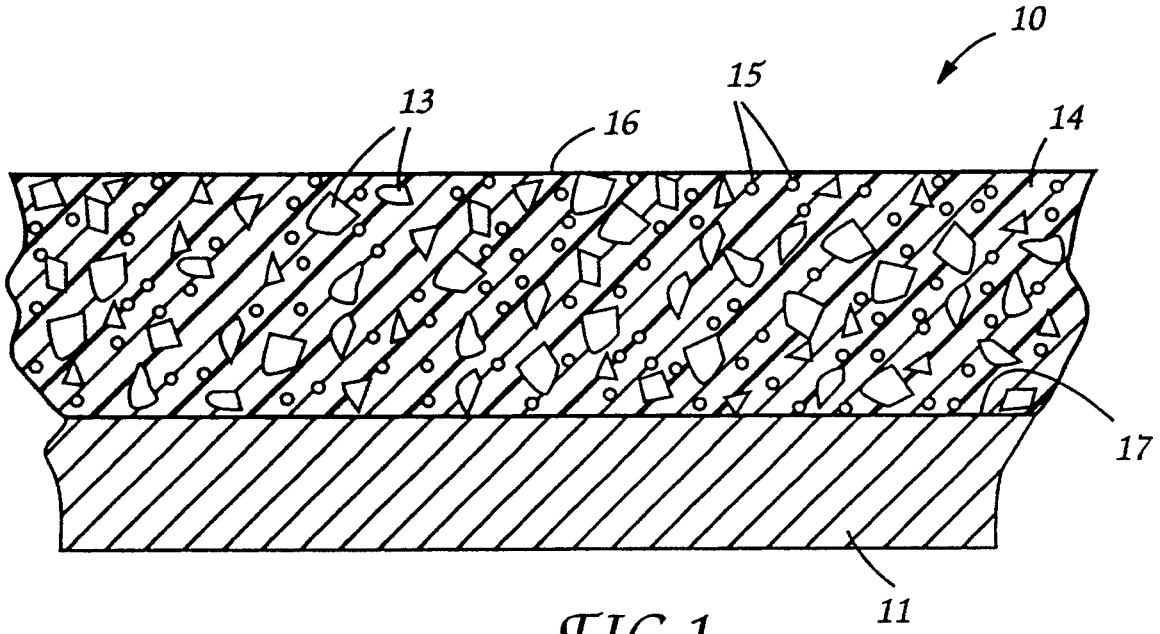
FIG. 1 is a section view, enlarged, of an abrasive article embodiment of this invention.

Referring to FIG. 1, an abrasive article 10 within the invention has a backing 11 having an abrasive coating 16 bonded to at least the front surface 17 of the backing. The abrasive coating 16 comprises a homogeneous mixture of a plurality of abrasive particles 13, a binder 14 and a grinding aid 15. The binder 14 serves also to bond the abrasive coating 16 to the front surface 17 of the backing 11. The abrasive particles are essentially uniformly dispersed throughout the binder and grinding aid mixture. The abrasive article illustrated and enlarged in FIG. 1 is typically produced by knife coating slurry onto the backing, it being understood that other coating methods, such as gravure coating, would produce a more variated surface.

BACKING

The backing of this invention has a front and back surface and can be any conventional abrasive backing. Examples of useful backings include polymeric film, primed polymeric film, cloth, paper, vulcanized fiber, nonwovens, and combinations thereof. Other useful backings include a fibrous reinforced thermoplastic backing as disclosed in U.S. Pat. No. 5,316,812 and an endless seamless backing as disclosed in World Patent Application No. WO 93/12911 published. The backing may also contain a treatment or treatments to seal the backing and/or modify some physical properties of the backing. These treatments are well known in the art.

The backing may also have an attachment means on its back surface to enable securing the resulting coated abrasive to a support pad or back-up pad. This attachment means can be a pressure sensitive adhesive, one surface of a hook and loop attachment system, or a threaded projection as disclosed in the above-mentioned U.S. Pat. No. 5,316,812. Alternatively, there may be an intermeshing attachment system as described in the assignee's U.S. Pat. No. 5,201,101 incorporated herein after by reference.

The back side of the abrasive article may also contain a slip resistant or frictional coating. Examples of such coatings include an inorganic particulate (e.g., calcium carbonate or quartz) dispersed in an adhesive.

ABRASIVE COATING

Abrasive Particles

The abrasive particles typically have a particle size ranging from about 0.1 to 1500 micrometers, usually between about 0.1 to 400 micrometers, preferably between 0.1 to 100 micrometers and most preferably between 0.1 to 50 micrometers. It is preferred that the abrasive particles have a Mohs' hardness of at least about 8, more preferably above 9. Examples of such abrasive particles include fused aluminum oxide (which includes brown aluminum oxide, heat treated aluminum oxide and white aluminum oxide), ceramic aluminum oxide, green silicon carbide, silicon carbide, chromia, alumina zirconia, diamond, iron oxide, ceria, cubic boron nitride, boron carbide, garnet and combinations thereof.

The term "abrasive particle" also encompasses when single abrasive particles are bonded together to form an abrasive agglomerate. Abrasive agglomerates are further described in U.S. Pat. Nos. 4,311,489; 4,652,275 and 4,799,939 incorporated herein by reference.

It is also within the scope of this invention to have a surface coating on the abrasive particles. The surface coating may have many different functions. In some instances the surface coatings increase adhesion of abrasive particles to the binder, alter the abrading characteristics of the abrasive particle, and the like. Examples of surface coatings include coupling agents, halide salts, metal oxides including silica, refractory metal nitrides, refractory metal carbides and the like.

In the abrasive composite there may also be diluent particles. The particle size of these diluent particles may be on the same order of magnitude as the abrasive particles. Examples of such diluent particles include gypsum, marble, limestone, flint, silica, glass bubbles, glass beads, aluminum silicate, and the like.

Binder

The abrasive particles are dispersed in an organic binder to form the abrasive composite. The binder is derived from a binder precursor which comprises an organic polymerizable resin. During the manufacture of the inventive abrasive articles, the binder precursor is exposed to an energy source which aids in the initiation of the polymerization or curing process. Examples of energy sources include thermal energy and radiation energy, the latter including electron beam, ultraviolet light, and visible light. During this polymerization process, the resin is polymerized and the binder precursor is converted into a solidified binder. Upon solidification of the binder precursor, the abrasive coating is formed. The binder in the abrasive coating is also generally responsible for adhering the abrasive coating to the backing.

There are two preferred classes of resins for use in the present invention, condensation curable and addition polymerizable resins. The preferred binder precursors comprise additional polymerizable resins because these resins are readily cured by exposure to radiation energy. Addition polymerizable resins can polymerize through a cationic mechanism or a free radical mechanism. Depending upon the energy source that is utilized and the binder precursor chemistry, a curing agent, initiator, or catalyst is sometimes preferred to help initiate the polymerization.

Examples of typical and preferred organic resins include phenolic resins, urea-formaldehyde resins, melamine formaldehyde resins, acrylated urethanes, acrylated epoxies, ethylenically unsaturated compounds, aminoplast derivatives having pendant unsaturated carbonyl groups, isocyanurate derivatives having at least one pendant acrylate group, isocyanate derivatives having at least one pendant acrylate group, vinyl ethers, epoxy resins, and mixtures and combinations thereof. The term "acrylate" encompasses acrylates and methacrylates.

Phenolic resins are widely used in abrasive article binders because of their thermal properties, availability, and cost. There are two types of phenolic resins, resole and novolac. Resole phenolic resins have a molar ratio of formaldehyde to phenol of greater than or equal to one to one, typically between 1.5:1.0 to 3.0:1.0. Novolac resins have a molar ratio of formaldehyde to phenol of less than one to one. Examples of commercially available phenolic resins include those known by the tradenames "Durez" and "Varcum" from Occidental Chemicals Corp.; "Resinox" from Monsanto; "Aerofene" from Ashland Chemical Co. and "Aerotap" from Ashland Chemical Co.

Acrylated urethanes are diacrylate esters of hydroxy-terminated, isocyanate NCO extended polyesters or polyethers. Examples of commercially available acrylated urethanes include those known under the trade designations "UVITHANE 782", available from Morton Thiokol Chemical, and "CMD 6600", "CMD 8400", and "CMD 8805", available from Radcure Specialties.

Acrylated epoxies are diacrylate esters of epoxy resins, such as the diacrylate esters of bisphenol A epoxy resin. Examples of commercially available acrylated epoxies include those known under the trade designations "CMD 3500", "CMD 3600", and "CMD 3700", available from Radcure Specialities.

Ethylenically unsaturated resins include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups.

Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyladkipamide. Still other nitrogen containing compounds include tris(2-acryloyloxyethyl)isocyanurate, 1,3,5-tri(2-methyacryloxyethyl)-triazine, acrylamide, methylacrylamide, N-methylacrylamide, N,N-dimethylacrylamide, N-vinylpyrrolidone, and N-vinylpiperidone.

The aminoplast resins have at least one pendant alpha, betaunsaturated carbonyl group per molecule or oligomer. These unsaturated carbonyl groups can be acrylate, methacrylate, or acrylamide type groups. Examples of such materials include N-(hydroxymethyl)acrylamide, N,N'-oxydimethylenebisacrylamide, ortho and para acrylamidomethylated phenol, acrylamidomethylated phenolic novolac, and combinations thereof.

These materials are further described in U.S. Pat. Nos. 4,903,440 and 5,236,472 both incorporated herein by reference.

Isocyanurate derivatives having at least one pendant acrylate group and isocyanate derivatives having at least one pendant acrylate group are further described in U.S. Pat. No. 4,652,274 incorporated herein after by reference. The preferred isocyanurate material is a triacrylate of tris(hydroxy ethyl) isocyanurate.

Epoxy resins have an oxirane and are polymerized by the ring opening. Such epoxide resins include monomeric epoxy resins and oligomeric epoxy resins. Examples of some preferred epoxy resins include 2,2-bis[4-(2,3-epoxypropoxy)-phenyl propane] (diglycidyl ether of bisphenol) and commercially available materials under the trade designations "Epon 828", "Epon 1004", and "Epon 1001F" available from Shell Chemical Co., "DER-331", "DER-332", and "DER-334" available from Dow Chemical Co. Other suitable epoxy resins include glycidyl ethers of phenol formaldehyde novolac (e.g., "DEN-431" and "DEN-428" available from Dow chemical Co.).

The epoxy resins of the invention can polymerize via a cationic mechanism with the addition of an appropriate cationic curing agent. Cationic curing agents generate an acid source to initiate the polymerization of an epoxy resin. These cationic curing agents can include a salt having an onium cation and a halogen containing a complex anion of a metal or metalloid. Other cationic curing agents include a salt having an organometallic complex cation and a halogen containing complex anion of a metal or metalloid which are further described in U.S. Pat. No. 4,751,138 incorporated here in after by reference (column 6, line 65 to column 9, line 45). Another example is an organometallic salt and an onium salt is described in U.S. Pat. No. 4,985,340 (column 4, line 65 to column 14, line 50); and European Patent Application Nos. 306,161 and 306,162, both published Mar. 8, 1989, all incorporated by reference. Still other cationic curing agents include an ionic salt of an organometallic complex in which the metal is selected from the elements of Periodic Group IVB, VB, VIB, VIIB and VIIIB which is described in European Patent Application No. 109,581, published Nov. 21, 1983, incorporated by reference.

Regarding free radical curable resins, in some instances it is preferred that the abrasive slurry further comprise a free radical curing agent. However in the case of an electron beam energy source, the curing agent is not always required because the electron beam itself generates free radicals.

Examples of free radical thermal initiators include peroxides, e.g., benzoyl peroxide, azo compounds, benzophenones, and quinones. For either ultraviolet or visible light energy source, this curing agent is sometimes referred to as a photoinitiator. Examples of initiators, that when exposed to ultraviolet light generate a free radical source, include but are not limited to those selected from the group consisting of organic peroxides, azo compounds, quinones, benzophenones, nitroso compounds, acryl halides, hydrozones, mercapto compounds, pyrylium compounds, triacrylimdazoles, bisimidazoles, chloroalkytriazines, benzoin ethers, benzil ketals, thioxanthones, and acetophenone derivatives, and mixtures thereof. Examples of initiators that when exposed to visible radiation generate a free radical source, can be found in U.S. Pat. No. 4,735,632, entitled Coated Abrasive Binder Containing Ternary Photoinitiator System, incorporated herein by reference. The preferred initiator for use with visible light is "Irgacure 369" commercially available from Ciba Geigy Corporation.

GRINDING AID

A grinding aid is defined as a material, preferably a particulate material, the addition of which to an abrasive article has a significant effect on the chemical and physical processes of abrading which results in improved performance. Typically and preferably the grinding aid is added to the slurry as a particulate, however it may be added to the slurry as a liquid. The presence of the grinding aid will increase the grinding efficiency or cut rate (defined as weight of work piece removed per weight of abrasive article lost) of the corresponding abrasive article in comparison to an abrasive article that does not contain a grinding aid. In particular, it is believed in the art that the grinding aid will either 1) decrease the friction between the abrasive grains and the workpiece being abraded, 2) prevent the abrasive grain from "capping", i.e., prevent metal particles (in the case of a metal workpiece) from becoming welded to the tops of the abrasive grains, 3) decrease the interface temperature between the abrasive grains the workpiece, 4) decreases the grinding force required, or 5) prevents oxidation of the metal workpiece. In general, the addition of a grinding aid increases the useful life of the abrasive article.

Grinding aids useful in the invention encompass a wide variety of different materials and can be inorganic or organic based. Examples of chemical groups of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphtalene, pentachloronaphthalene; and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include, tin, lead, bismuth, cobalt, antimony, cadmium, iron titanium, other miscellaneous grinding aids include sulfur, organic sulfur compounds, graphite and metallic sulfides. It is also within the scope of this invention to use a combination of different grinding aids and in some instances this may produce a synergistic effect.

The above-mentioned examples of grinding aids are meant to be representative only. A preferred grinding aid for use in the invention is cryolite, and the most preferred is potassium tetrafluoroborate ($KBF_4$).

The grinding aid is considered to be non-abrasive, that is, the Moh hardness of the grinding aid is less than 8. The grinding aid may also contain impurities; these impurities should not significantly adversely affect performance of the abrasive article.

The grinding aid particle size preferably ranges from about 0.1 to 100 micrometers, more preferably between 10 to 70 micrometers. In general the particle size of the grinding aid is preferably equal to or less than the size of the abrasive particles.

The abrasive coating comprises generally at least about 1% by weight, typically at least about 2.5% by weight, preferably at least about 5% by weight, more preferably at least about 10% by weight grinding aid and most preferably at least about 20% by weight grinding aid. More than about 50 weight % grinding aid may be detrimental since it is theorized that grinding performance would decrease (since there are less abrasive particles present). It was surprising that as the amount of grinding aid was increased, the relative grinding performance as measured by cut rate is also increased. This was unexpected since as the amount of grinding aid in the abrasive coating is increased, the relative amount of abrasive particles is decreased. The abrasive particles are responsible for cutting the workpiece surface, not the grinding aid. In general, the abrasive coating comprises from 5 to 90% by weight, preferably from 20 to 80% by weight abrasive particles, from 5 to 80% by weight, preferably from 5 to 40% by weight binder, and from 5 to 60% by weight, preferably from 10 to 40% by weight grinding aid.

OPTIONAL ADDITIVES

Slurries useful in the invention may further comprise optional additives, such as, for example, fillers, fibers, lubricants, wetting agents, thixotropic materials, surfactants, pigments, dyes, antistatic agents, coupling agents, plasticizers, and suspending agents. The amounts of these materials are selected to provide the properties desired. The use of these can affect the erodability of the abrasive composite. In some instances an additive is purposely added to make the abrasive composite more erodable, thereby expelling dulled abrasive particles and exposing new abrasive particles.

Examples of antistatic agents useful in the invention include graphite, carbon black, vanadium oxide, humectants, and the like. These antistatic agents are disclosed in U.S. Pat. Nos. 5,061,294; 5,137,542, and 5,203,884 incorporated herein after by reference.

A coupling agent can provide an association bridge between the binder precursor and the filler particles or abrasive particles. Examples of useful coupling agents include silanes, titanates, and zircoaluminates. Useful slurries preferably contain from about 0.01 to 3% by weight coupling agent.

An example of a suspending agent useful in the invention is an amorphous silica particle having a surface area less than 150 meters square/gram that is commercially available from DeGussa Corp., under the trade name "OX-50".

ABRASIVE COATING COMPRISING ABRASIVE COMPOSITES

In one preferred aspect of the invention, the abrasive coating is in the form of a plurality of abrasive composites bonded to the backing. It is generally preferred that each abrasive composites have a precise shape. The precise shape of each composite is determined by distinct and discernible boundaries. These distinct and discernible boundaries are readily visible and clear when a cross section of the abrasive article is examined under a microscope such as a scanning electron microscope. In comparison, in an abrasive coating comprising composites that do not have precise shapes, the boundaries are not definitive and may be illegible. These distinct and discernible boundaries form the outline or contour of the precise shape. These boundaries separate to some degree one abrasive composite from another and also distinguish one abrasive composite from another.

Figure 2:
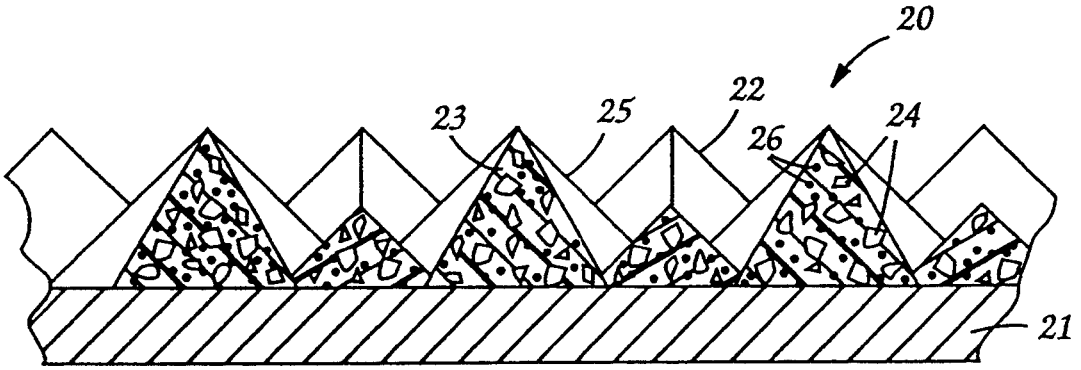
FIG. 2 is a section view, enlarged, representing another abrasive article embodiment of this invention.

Referring to FIG. 2, the abrasive article 20 comprises abrasive composites 22 separated by boundary 25. The boundary or boundaries associated with the composite shape result in one abrasive composite being separated to some degree from another adjacent abrasive composite. To form an individual abrasive composite, a portion of the boundaries forming the shape of the abrasive composite must be separated from one another. Note that in FIG. 2, the base or a portion of the abrasive composite closest to the backing can abutt with its neighboring abrasive composite. (Note that "neighboring" does not necessarily mean "adjacent".) Abrasive composites 22 comprise a plurality of abrasive particles 24 that are dispersed in a binder 23 and a grinding aid 26. It is also within the scope of this invention to have a combination of abrasive composites bonded to a backing in which some of the abrasive composites abutt, while other abrasive composites have open spaces between them.

In some instances the boundaries forming the shape are planar. For shapes that have planes, there are at least three planes. The number of planes for a given shape can vary depending upon the desired geometry, for instance the number of planes can range from three to over 20. Generally, there are between three to ten planes, preferably between three to six planes. These planes intersect to form the desired shape and the angles at which these planes intersect will determine the shape dimensions.

In another aspect of this invention, a portion of the abrasive composites have a neighboring abrasive composite of a different dimension. In this aspect of the invention, at least 10%, preferably at least 30%, more preferably at least 50% and most preferably at least 60% of the abrasive composites have an adjacent abrasive composite that has a different dimension. These different dimensions can pertain to the abrasive composite shape, angle between planar boundaries or dimensions of the abrasive composite. The result of these different dimensions for neighboring abrasive composites results in an abrasive article that produces a relatively finer surface finish on the workpiece being abraded or refined. This aspect of the invention is further described in the assignee's co-pending patent application U.S. Ser. No. 08/120,300 filed Sep. 13, 1993.

The abrasive composite shape can be any shape, but it is preferably a geometric shape such as a rectangle, cone, semicircle, circle, triangle, square, hexagon, pyramid, octagon and the like. The preferred shape is a pyramid and the base of this pyramid can be a three or four sided. It is also preferred that the abrasive composite cross sectional surface area decreases away from the backing or decreases along its height. This variable surface area results in a non-uniform pressure as the abrasive composite wears during use. Additionally, during manufacture of the abrasive article, this variable surface area results in easier release of the abrasive composite from the production tool. In general there are at least 5 individual abrasive composites per square cm. In some instances, there may be at least 500 individual abrasive composites/square cm.

METHOD OF MAKING THE ABRASIVE ARTICLE

An essential step to make any of the inventive abrasive articles is to prepare the slurry. The slurry is made by combining together by any suitable mixing technique the binder precursor, the grinding aid, the abrasive particles and the optional additives. Examples of mixing techniques include low shear and high shear mixing, with high shear mixing being preferred. Ultrasonic energy may also be utilized in combination with the mixing step to lower the abrasive slurry viscosity. Typically, the abrasive particles and grinding aid are gradually added into the binder precursor. The amount of air bubbles in the slurry can be minimized by pulling a vacuum during the mixing step. In some instances it is preferred to heat, generally in the range of 30° to 70° C., the slurry to lower the viscosity. It is important the slurry have theological properties that allow the slurry to coat well and in which the abrasive particles and grinding aid do not settle out of the slurry.

Relative to the second aspect of the invention, the slurry is coated on at least the front surface of a backing. This coating can be accomplished by any conventional technique such as roll coating, gravure coating, knife coating, spray coating, transfer coating, vacuum die coating, die coating and the like.

ENERGY SOURCE

After the slurry is coated onto the backing, the slurry is exposed to an energy source to initiate the polymerization of the resin in the binder precursor. Examples of energy sources include thermal energy and radiation energy. The amount of energy depends upon several factors such as the binder precursor chemistry, the dimensions of the abrasive slurry, the amount and type of abrasive particles and the amount and type of the optional additives. For thermal energy, the temperature can range from about 30° to 150° C., generally from 40° to 120° C. The exposure time can range from about 5 minutes to over 24 hours.

Suitable radiation energy sources include electron beam, ultraviolet light, or visible light. Electron beam radiation, which is also known as ionizing radiation, can be used at an energy level of about 0.1 to about 10 Mrad, preferably at an energy level of about 1 to about 10 Mrad. Ultraviolet radiation refers to non-particulate radiation having a wavelength within the range of about 200 to about 400 nanometers, preferably within the range of about 250 to 400 nanometers. Visible radiation refers to non-particulate radiation having a wavelength within the range of about 400 to about 800 nanometers, preferably in the range of about 400 to about 550 nanometers. It is preferred that 300 to 600 Watt/inch visible lights are used.

After this polymerization process is complete, the binder precursor is converted into a binder and the slurry is converted into an abrasive coating. The resulting abrasive article is generally ready for use. However, in some instances other processes may still be necessary such as humidification or flexing. The abrasive article can be converted into any desired form such as a cone, endless belt, sheet, disc, and the like, before the abrasive article is used.

PRODUCTION TOOL

Regarding the third and fourth aspects of the invention, in some instances it is preferred that the abrasive coating be present as precisely shaped abrasive composites. In order to make this type of abrasive article, a production tool is generally required.

The production tool contains a plurality of cavities. These cavities are essentially the inverse shape of the abrasive composite and are responsible for generating the shape of the abrasive composites. The dimensions of the cavities are selected to provide the desired shape and dimensions of the abrasive composites. If the shape or dimensions of the cavities are not properly fabricated, the resulting production tool will not provide the desired dimensions for the abrasive composites.

The cavities can be present in a dot like pattern with spaces between adjacent cavities or the cavities can butt up against one another. It is preferred that the cavities butt up against one another. Additionally, the shape of the cavities is selected such that the cross-sectional area of the abrasive composite decreases away from the backing.

The production tool can be a belt, a sheet, a continuous sheet or web, a coating roll such as a rotogravure roll, a sleeve mounted on a coating roll, or die. The production tool can be composed of metal, (e.g., nickel), metal alloys, or plastic. The metal production tool can be fabricated by any conventional technique such as engraving, bobbing, electroforming, diamond turning, and the like. One preferred technique for a metal production tool is diamond turning.

A thermoplastic tool can be replicated off a metal master tool. The master tool will have the inverse pattern desired for the production tool. The master tool can be made in the same manner as the production tool. The master tool is preferably made out of metal, e.g., nickel and is diamond turned. The thermoplastic sheet material can be heated and optionally along with the master tool such that the thermoplastic material is embossed with the master tool pattern by pressing the two together. The thermoplastic can also be extruded or cast onto the master tool and then pressed. The thermoplastic material is cooled to solidify and produce the production tool. Examples of preferred thermoplastic production tool materials include polyester, polycarbonates, polyvinyl chloride, polypropylene, polyethylene and combinations thereof. If a thermoplastic production tool is utilized, then care must be taken not to generate excessive heat that may distort the thermoplastic production tool.

The production tool may also contain a release coating to permit easier release of the abrasive article from the production tool. Examples of such release coatings for metals include hard carbide, nitrides or borides coatings. Examples of release coatings for thermoplastics include silicones and fluorochemicals.

Figure 3:
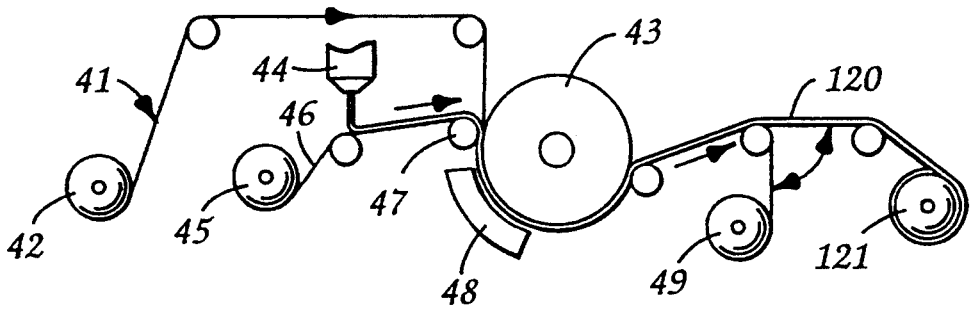
FIG. 3 is a schematic of a process of making the abrasive article of FIG. 2.

One method to make the abrasive article of the invention illustrated in FIG. 2 is illustrated in FIG. 3. Backing 41 leaves an unwind station 42 and at the same time the production tool 46 leaves an unwind station 45. Production tool 46 is coated with slurry by means of coating station 44. It is possible to heat the slurry and/or subject the slurry to ultrasonics prior to coating to lower the viscosity. The coating station can be any conventional coating means such as drop die coater, knife coater, curtain coater, vacuum die coater or a die coater. During coating the formation of air bubbles should be minimized. The preferred coating technique is a vacuum fluid bearing die, such as disclosed in U.S. Pat. Nos. 3,594,865, 4,959,265, and 5,077,870, all incorporated herein by reference. After the production tool is coated, the backing and the slurry are brought into contact by any means such that the slurry wets the front surface of the backing. In FIG. 3, the slurry is brought into contact with the backing by means of contact nip roll 47. Next, contact nip roll 47 also forces the resulting construction against support drum 43. A source of energy 48 (preferably a source of visible light) transmits a sufficient amount of energy into the slurry to at least partially cure the binder precursor. The term partial cure is meant that the binder precursor is polymerized to such a state that the slurry does not flow from an inverted test tube. The binder precursor can be fully cured once it is removed from the production tool by any energy source. Following this, the production tool is rewound on mandrel 49 so that the production tool can be reused again. Additionally, abrasive article 120 is wound on mandrel 121. If the binder precursor is not fully cured, the binder precursor can then be fully cured by either time and/or exposure to an energy source. Additional steps to make abrasive articles according to this first method are further described in U.S. Pat. No. 5,152,917 and U.S. Ser. No. 08/004,929, filed Jan. 14, 1993, both incorporated herein by reference. Randomly shaped abrasives composites may be made by the tooling and procedures described in copending Ser. No. 08/120,300, filed Sep. 13, 1993, incorporated herein by reference.

It is preferred that the binder precursor is cured by radiation energy. The radiation energy can be transmitted through the production tool so long as the production tool does not appreciably absorb the radiation energy. Additionally, the radiation energy source should not appreciably degrade the production tool. It is preferred to use a thermoplastic production tool and ultraviolet or visible light.

Regarding the fourth aspect of the invention, the slurry can be coated onto the backing and not into the cavities of the production tool. The slurry coated backing is then brought into contact with the production tool such that the slurry flows into the cavities of the production tool. The remaining steps to make the abrasive article are the same as detailed above.

Figure 4:
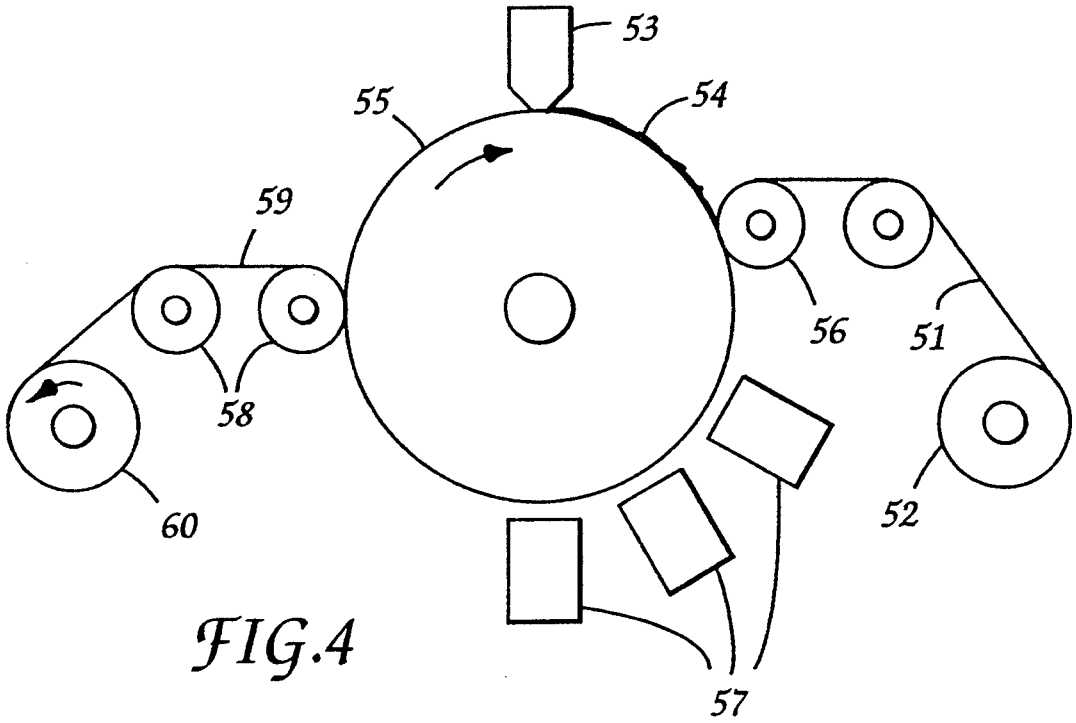
FIG. 4 is a schematic of another process of making the abrasive article of FIG. 2.

Another method is illustrated in FIG. 4. Backing 51 leaves an unwind station 52 and the slurry 54 is coated into the cavities of the production tool 55 by means of the coating station 53. The slurry can be coated onto the tool by any one of many techniques such as drop die coating, roll coating, knife coating, curtain coating, vacuum die coating, or die coating. Again, it is possible to heat the slurry and/or subject the slurry to ultrasonics prior to coating to lower the viscosity. During coating the formation of air bubbles should be minimized. Then, the backing and the production tool containing the abrasive slurry are brought into contact by a nip roll 56 such that the slurry wets the front surface of the backing. Next, the binder precursor in the slurry is at least partially cured by exposure to an energy source 57. After this at least partial cure, the slurry is converted to an abrasive composite 59 that is bonded or adhered to the backing. The resulting abrasive article is removed from the production tool by means of nip rolls 58 and wound onto a rewind station 60. In this method, the energy source can be thermal energy or radiation energy. If the energy source is either ultraviolet light or visible light, it is preferred that the backing be transparent to ultraviolet or visible light. An example of such a backing is polyester backing.

Regarding the fourth aspect of the invention, the slurry can be coated directly onto the front surface of the backing. The slurry coated backing is then brought into contact with the production tool such that the slurry wets into the cavities of the production tool. The remaining steps to make the abrasive article are the same as detailed above.

METHOD OF REFINING A WORKPIECE SURFACE

The fifth aspect of this invention pertains to a method of abrading a metal surface. This method involves bringing into frictional contact the abrasive article of this invention with a workpiece having a metal surface. The term "abrading" means that a portion of the metal workpiece is cut or removed by the abrasive article. Additionally, the surface finish associated with the workpiece surface is typically reduced after this refining process. One typical surface finish measurement is Ra; Ra is the arithmetic surface finish generally measured in microinches or micrometers. The surface finish can be measured by a profilometer, such as a Perthometer or Surtronic.

WORKPIECE

The metal workpiece can be any type of metal such as mild steel, stainless steel, titanium, metal alloys, exotic metal alloys and the like. The workpiece may be flat or may have a shape or contour associated with it.

Depending upon the application, the force at the abrading interface can range from about 0.1 kg to over 1000 kg. Generally this range is from 1 kg to 500 kg of force at the abrading interface. Also depending upon the application, there may be a liquid present during abrading. This liquid can be water and/or an organic compound. Examples of typical organic compounds include lubricants, oils, emulsified organic compounds, cutting fluids, soaps, or the like. These liquids may also contain other additives such as defoamers, degreasers, corrosion inhibitors, or the like. The abrasive article may oscillate at the abrading interface during use. In some instances, this oscillation may result in a finer surface on the workpiece being abraded.

The abrasive articles of the invention can be used by hand or used in combination with a machine. At least one or both of the abrasive article and the workpiece is moved relative to the other during grinding. The abrasive article can be converted into a belt, tape roll, disc, sheet, and the like. For belt applications, the two free ends of an abrasive sheet are joined together and a splice is formed. It is also within the scope of this invention to use a spliceless belt like that described in the assignee's co-pending patent application U.S. Ser. No. 07/919,541, filed Jul. 24, 1992, incorporated herein after by reference. Generally the endless abrasive belt traverses over at least one idler roll and a platen or contact wheel. The hardness of the platen or contact wheel is adjusted to obtain the desired rate of cut and workpiece surface finish. The abrasive belt speed depends upon the desired cut rate and surface finish. The belt dimensions can range from about 5 mm to 1,000 mm wide and from about 5 mm to 10,000 mm long. Abrasive tapes are continuous lengths of the abrasive article. They can range in width from about 1 mm to 1,000 mm, generally between 5 mm to 250 mm. The abrasive tapes are usually unwound, traverse over a support pad that forces the tape against the workpiece and then rewound. The abrasive tapes can be continuously feed through the abrading interface and can be indexed. The abrasive disc can range from about 50 mm to 1,000 mm in diameter. Typically abrasive discs are secured to a back-up pad by an attachment means. These abrasive discs can rotate between 100 to 20,000 revolutions per minute, typically between 1,000 to 15,000 revolutions per minute.

EXAMPLES

The following non-limiting examples will further illustrate the invention. All parts, percentages, ratios, etc., in the examples are by weight unless otherwise indicated. The following abbreviations are used throughout:

TMPTA trimethylol propane triacrylate;

TATHEIC triacrylate of tris(hydroxy ethyl-)isocyanurate;

PH2 2-benzyl-2-N,N-dimethylamino-1-(4-morpholinophenyl)-1-butanone, commercially available from Ciba Geigy Corp. under the trade designation "Irgacure 369";

ASF amorphous silica filler, commercially available from DeGussa under the trade designation "OX-50";

CAO grade P320 ceramic aluminum oxide according to the teachings of U.S. Pat. No. 4,881,951;

FAO grade P320 fused heat treated aluminum oxide;

SCA silane coupling agent, 3-methacryloxypropyltrimethoxysilane, commercially available from Union Carbide under the trade designation "A-174";

CRY synthetic cryolite commercially available from Washington Mills

KBF 98% pure micropulverized potassium tetrafluoroborate, in which at least 95% by weight passes through a 325 mesh screen and a 100% by weight passes through a 200 mesh screen;

GENERAL PROCEDURE I FOR MAKING THE ABRASIVE ARTICLE

An abrasive slurry was prepared by mixing the abrasive particles, binder precursor and optionally other materials forming the abrasive slurry. The slurry was mixed for 20 minutes at 1200 rpm using a high shear mixer. The backing was a J weight rayon backing. The backing had a latex/phenolic resin treatment (85 parts/15 parts based upon a cured resin) on the front side of the backing. The presize was applied to the backing and then heated to substantially remove any volatiles and to gel the phenolic resin.

The abrasive article was made on apparatus illustrated in FIG. 3. The production tool was polypropylene tool that was embossed off a diamond turned nickel master tool which had a pyramidal type pattern. The pyramids were placed such that their bases were butted up against one another. The width of the pyramid base was about 180 micrometers and the pyramid height was about 180 micrometers. The abrasive slurry was knife coated about 15 cm wide into the cavities of the production tool. The knife gap was approximately 76 micrometers (3 mils). The radiation source was one visible lamp operating at 600 Watts/inch. The process was a continuous process operating at approximately 15 meters/minute (50 feet/minute). The nip pressure between the production tool and the backing was about 40 pounds. After the abrasive article was removed from the apparatus FIG. 3, it was heated for 12 hours at 115° C. to fully cure the latex/phenolic backing treatment. The abrasive article was not flexed prior to testing.

GENERAL PROCEDURE II FOR MAKING THE ABRASIVE ARTICLE

General Procedure II was essentially the same as General Procedure I except that a different production tool was utilized. The production tool is the same as described in Example 1 of the Hoopman patent application, Ser. No. 08/120,300, filed Sep. 13, 1993.

TEST PROCEDURE I

The coated abrasive was converted into 7.6 cm by 335 cm endless belt and tested on a constant load surface grinder. A preweighed, 304 stainless steel workpiece approximately 2.5 cm by 5 cm by 18 cm was mounted in a holder. The workpiece was positioned vertically, with the 2.5 cm 18 cm face facing an approximately 36 cm diameter 65 Shore A durometer serrated rubber contact wheel with one on one lands over which was entrained the coated abrasive belt. The workpiece was then reciprocated vertically through an 18 cm path at the rate of 20 cycles per minute, while a spring loaded plunger urged the workpiece against the belt with a load of 4.5 kg (10 lbs) as the belt was driven at about 1500 revolutions per minute. After a minute of grinding, the workpiece holder assembly was removed and re-weighed, the amount of stock removed calculated by subtracting the abraded weight from the original weight, and a new, preweighed workpiece and holder were mounted on the equipment. For the first minute of grinding only, the workpiece holder assembly was removed after thirty seconds and a second workpiece holder assembly was installed for the remaining thirty seconds of grinding. The initial cut and initial surface finish was take after 30 seconds of grinding. Additionally, the surface finish (Ra) of the workpiece was also measured and this procedure will be described below. The test endpoint was 10 minutes of grinding or when the workpiece started to burn.

TEST PROCEDURE II

Test Procedure II was essentially the same as Test Procedure I except that the workpiece was 1018 mild steel.

RA

Ra is a common men, sure of roughness used in the abrasives industry. Ra is defined as the arithmetic mean of the departures of the roughness profile from the mean line. Ra was measured with a profilometer probe, which was a diamond tipped stylus. In general, the lower the Ra value was, the smoother or finer the workpiece surface finish. The results were recorded in micrometers. The profilometer used was a Perthen M4P.

EXAMPLES 1 THROUGH 6 AND COMPARATIVE EXAMPLES A THROUGH D

This set of examples compared the abrasive articles of the invention with a conventional abrasive articles. The resulting abrasive articles were tested according to Test Procedure I and the test results can be found in Table 2.

Examples 1 through 6 and Comparative Examples C and D were made according to General Procedure I for Making the Abrasive Article. The formulations of the abrasive slurries can be found in Table 1, the amounts listed were measured in kilograms.

TABLE 1

| | Abrasive Slurry Formulations | | | | | | | |
|---|---|---|---|---|---|---|---|---|
| | 1 | 2 | 3 | 4 | 5 | 6 | C | D |
| TMPTA | 1.22 | 1.22 | 1.22 | 1.22 | 1.22 | 1.22 | 1.22 | 1.22 |
| TATHEIC | 0.52 | 0.52 | 0.52 | 0.52 | 0.52 | 0.52 | 0.52 | 0.52 |
| PH2 | .017 | .017 | .017 | .017 | .017 | .017 | .017 | .017 |
| ASF | 0.06 | 0.06 | 0.06 | 0.06 | 0.06 | 0.06 | 0.06 | 0.06 |
| SCA | 0.06 | 0.06 | 0.06 | 0.06 | 0.06 | 0.06 | 0.06 | 0.06 |
| FAO | 0 | 0 | 3.84 | 3.84 | 1.92 | 1.92 | 0 | 3.84 |
| CAO | 3.84 | 3.84 | 0 | 0 | 1.92 | 1.92 | 3.84 | 0 |
| CRY | 0.3 | 0 | 0.3 | 0 | 0.3 | 0 | 0 | 0 |
| KBF | 0 | 0.3 | 0 | 0.3 | 0 | 0.3 | 0 | 0 |

Comparative Example A was a grade P320 3M 201E Three-Mite Resin Bond cloth JE-VF coated abrasive commercially available from 3M Company, St. Paul, Minn. Comparative Example B was a grade P320 commercially available from VSM under the trade designation "KK511J".

TABLE 2

| | Test Procedure I | | |
|---|---|---|---|
| Example | Initial Cut grams | Initial Ra | Total Cut grams |
| 1 | 8.6 | 31 | 59.6 |
| 2 | 8.2 | 30 | 72.7 |
| 3 | 9.1 | 46 | 67.1 |
| 4 | 10.7 | 42 | 83.1 |
| 5 | 12.1 | 34 | 64.7 |
| 6 | 10.4 | 39 | 78.9 |
| A | 9.4 | 41 | 68.9 |
| B | 7.8 | 26 | 52.9 |
| C | 7.5 | 32 | 61.5 |
| D | 7.2 | 33 | 58.1 |

EXAMPLES 7 THROUGH 11

COMPARATIVE EXAMPLES A AND B

This set of examples compared the abrasive articles of the invention with a conventional abrasive articles. The resulting abrasive articles were tested according to Test Procedure I and the test results can be found in Table 4.

Examples 7 through 11 were made according to General Procedure II for Making the Abrasive Article. The formulations of the abrasive slurries can be found in Table 1, the amounts listed were measured in grams.

Additionally, the belts from Examples 8, 11 and Comparative Example A were tested according to Test Procedure II. This data can be found in Table 5.

TABLE 3

| | Abrasive Slurry Formulations | | | | |
|---|---|---|---|---|---|
| | 7 | 8 | 9 | 10 | 11 |
| TMPTA | 1218 | 1218 | 1218 | 1218 | |
| TATHEIC | 522 | 522 | 522 | 522 | 522 |
| PH2 | 17.4 | 17.4 | 17.4 | 17.4 | 17.4 |
| ASF | 60 | 60 | 60 | 60 | 60 |
| SCA | 60 | 60 | 60 | 60 | 60 |
| FAO | 2940 | 3240 | 3540 | 3840 | 3990 |
| KBF | 1200 | 900 | 600 | 300 | 150 |

TABLE 4

| | Test Procedure I | | |
|---|---|---|---|
| Example | Initial Cut grams | Initial Ra | Total Cut grams |
| 7 | 9.7 | 39 | 135.2 |
| 8 | 10.4 | 49 | 131.6 |
| 9 | 10.6 | 50 | 116.3 |
| 10 | 10.5 | 44 | 92.0 |
| 11 | 9.8 | 43 | 71.4 |
| A | 9.2 | 34 | 68.9 |

TABLE 4-continued

| | Test Procedure I | | |
|---|---|---|---|
| Example | Initial Cut grams | Initial Ra | Total Cut grams |
| B | 6.7 | 22 | 52.7 |

TABLE 5

| | Test Procedure II | | |
|---|---|---|---|
| Example | Initial Cut grams | Initial Ra | Total Cut grams |
| 8 | 10.7 | 42.3 | 233.2 |
| 11 | 12.3 | 42.6 | 278.9 |
| A | 16.6 | 35 | 142.8 |

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An abrasive article comprising:

a. a backing having a front and back surface; and b. an abrasive coating bonded to the front surface of the backing, the abrasive coating comprising a homogeneous mixture of a plurality of abrasive particles, a binder and a plurality of grinding aid particles having a size ranging from about 0.1 to about 100 micrometers, the binder serving to bond the abrasive coating to the backing, wherein the grinding aid particles comprise at least 1% by weight of the abrasive coating, but not more than 50% by weight, the grinding aid particles being selected from the group consisting of halide salts, the abrasive coating consisting essentially of a plurality of precisely shaped abrasive composites.

2. An abrasive article in accordance with claim 1 wherein said grinding aid particles are not more than 30% by weight of said abrasive coating.

3. An abrasive article in accordance with claim 1 wherein said grinding aid particles are cryolite.

4. An abrasive article in accordance with claim 1 wherein said grinding aid particles are potassium tetrafluoroborate.

5. An abrasive article comprising:

a. a backing having a front and back surface; and b. an abrasive coating bonded to the front surface of the backing, the abrasive coating comprising a homogeneous mixture of a plurality of abrasive particles, a binder and a plurality of cryolite grinding aid particles having a size ranging from about 0.1 to about 100 micrometers, the binder serving to bond the abrasive coating to the backing, wherein the grinding aid particles comprise at least 1% by weight of the abrasive coating, but not more than 50% by weight, the abrasive coating consisting essentially of a plurality of precisely shaped abrasive composites.

6. An abrasive article comprising:

a. a backing having a front and back surface; and b. an abrasive coating bonded to the front surface of the backing, the abrasive coating comprising a homogeneous mixture of a plurality of abrasive particles, a binder and a plurality of fluoroborate grinding aid particles having a size ranging from about 0.1 to about 100 micrometers, the binder serving to bond the abrasive coating to the backing, wherein the grinding aid particles comprise at least 1% by weight of the abrasive coating, but not more than 50% by weight, the abrasive coating consisting essentially of a plurality of precisely shaped abrasive composites.

7. An abrasive article comprising:

a. a J. weight rayon backing having a front and back surface, the front surface having a latex/phenolic resin treatment thereon; and b. an abrasive coating bonded to the front surface of the backing, the abrasive coating comprising a homogeneous mixture of a plurality of abrasive particles, a binder comprised of polymerized units of trimethylol propane triacrylate and a triacrylate of tris(hydroxy ethyl) isocyanurate, and a plurality of grinding aid particles having a size ranging from about 0.1 to about 100 micrometers, the binder serving to bond the abrasive coating to the backing, wherein the grinding aid particles comprise at least 1% by weight of the abrasive coating, but not more than 50% by weight, the grinding aid particles being selected from the group consisting of halide salts, the abrasive coating consisting essentially of a plurality of precisely shaped pyramidal abrasive composites, each composite having a base width and a height, the composites positioned such that their bases butt up against one another, the width of each pyramidal base being about 180 micrometers and the height of each pyramidal composite being about 180 micrometers.

8. In a method of abrading a metal surface of a workpiece, said method comprising the steps of bringing into frictional contact a metal surface and an abrasive article, the improvement wherein the abrasive article comprises:

i) a backing having a front and back surface;

ii) an abrasive coating bonded to at least the front surface of the backing, wherein the abrasive coating comprises a homogeneous mixture of a plurality of abrasive particles, a binder and a plurality of grinding aid particles having a size ranging from about 0.1 to about 100 micrometers; wherein the binder also serves to bond the abrasive coating to the backing and wherein the abrasive coating comprises by weight at least 1% but not more than 50% grinding aid, and wherein at least one of the abrasive article or the metal surface is moved during frictional contact such that a portion of the metal surface of the workpiece is removed, the grinding aid particles being selected from the group consisting of halide salts, the abrasive coating consisting essentially of a plurality of precisely shaped abrasive composites.

9. The method in accordance with claim 8 wherein said grinding aid is not more than 30% by weight of said abrasive coating.

10. The method in accordance with claim 8 wherein said grinding aid is cryolite.

11. The method in accordance with claim 8 wherein said grinding aid is potassium tetrafluoroborate.

* * * * *